United States Patent [19]

Dreher

[11] 4,325,784

[45] * Apr. 20, 1982

[54] COMBINED SIZE PRESS AND BREAKER STACK AND METHOD

[75] Inventor: George L. Dreher, Beloit, Wis.

[73] Assignee: Beloit Corporation, Beloit, Wis.

[ * ] Notice: The portion of the term of this patent subsequent to Mar. 11, 1997, has been disclaimed.

[21] Appl. No.: 132,126

[22] Filed: Mar. 20, 1980

[51] Int. Cl.[3] ..... D21H 1/10

[52] U.S. Cl. ..... 162/135; 162/265; 118/206; 118/262; 118/405; 118/414; 427/209; 427/211; 427/428; 427/434.3; 427/434.4; 427/439

[58] Field of Search ..... 162/264, 265, 135; 118/206, 262, 202, 405, 414; 427/196, 211, 428, 434.3, 434.4, 439, 209

[56] References Cited

U.S. PATENT DOCUMENTS

| | | | |
|---|---|---|---|
| 3,560,334 | 2/1971 | Arledter | 162/266 |
| 3,676,184 | 7/1972 | Spearin et al. | 118/224 |
| 3,830,197 | 8/1974 | Romaine | 118/104 |
| 4,192,712 | 3/1980 | Dreher | 162/265 |

*Primary Examiner*—Peter Chin

*Attorney, Agent, or Firm*—Hill, Van Santen, Steadman, Chiara & Simpson

[57] ABSTRACT

A combined size press and breaker stack comprising a breaker roll and a coating press roll and an intermediate roll selectively alternately shiftable into breaker nipping relation to the breaker roll or coating nip relation with the press roll, and guiding paper web, traveling continuously from a supply to a disposition point, to either of the alternately selected nips. Coating material is supplied to the paper web while traveling through the coating nip.

17 Claims, 2 Drawing Figures

COMBINED SIZE PRESS AND BREAKER STACK AND METHOD

Figure 1:
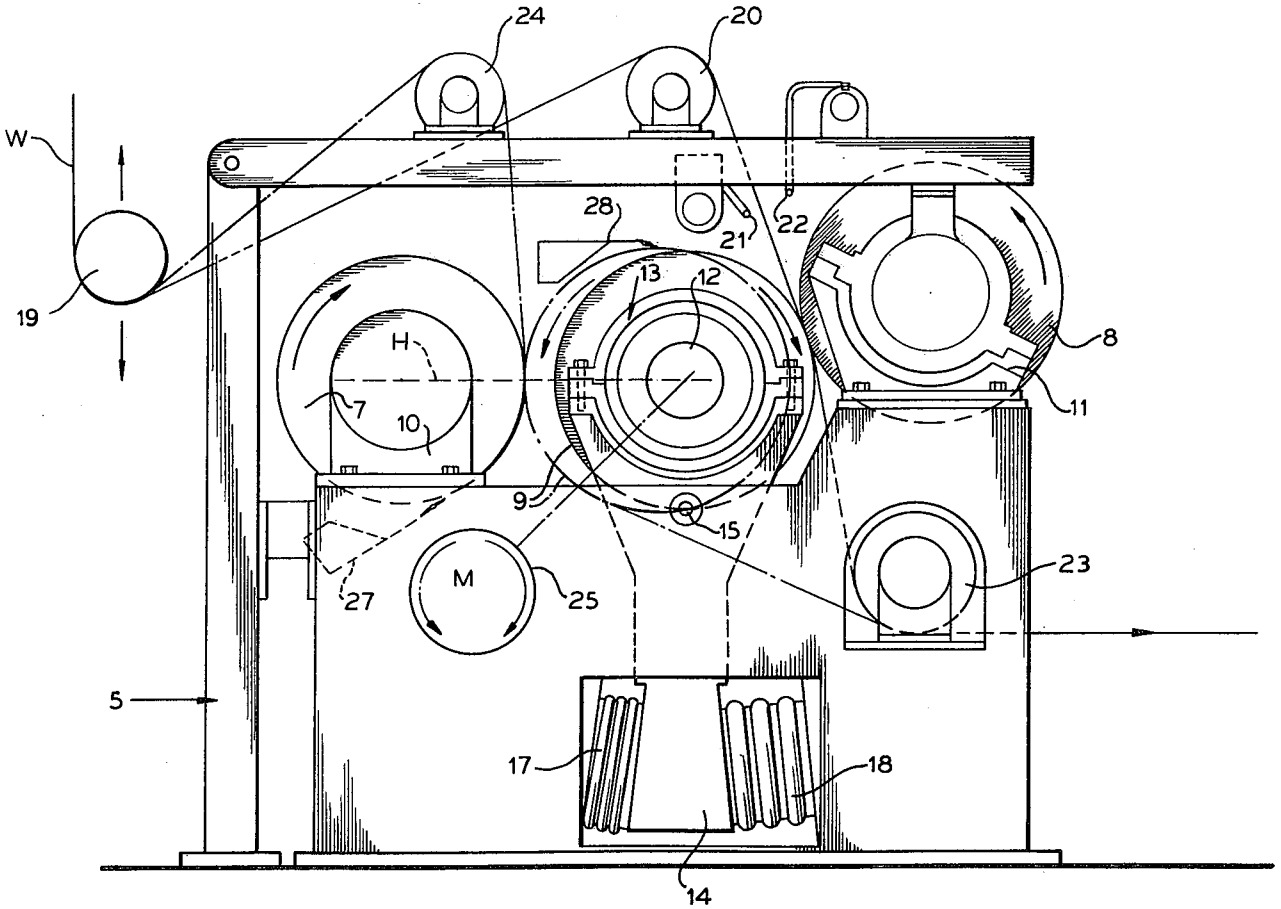

This invention relates to improvements in paper processing machines, and is more particularly concerned with processing or treating a continuously traveling paper web.

On groundwood specialty paper making machines, it is common practice to also run woodfree sheets. The groundwood directory, catalog and roto grades of paper are unsized sheets often run through a breaker stack to increase smoothness and to control caliper. Woodfree sheets require surface sizing to improve surface qualities and internal strength, but do not require the breaker operation.

Some paper making mills have used a single 2-roll press, and switch from breaker to sizing operation by changing out the rolls, since the groundwood breaker requires two chilled iron rolls and the size press normally has one hard and one soft rubber covered roll. Such roll changing out is time consuming and ties up the machine room crane.

Other mills may have both a breaker stack and a size press, and will bypass one or the other, depending on the paper grade being run. Such installations generally require long bypass sheet runs, as well as require extra equipment and building space. By way of example of a typical prior art arrangement, U.S. Pat. No. 3,676,184 is referred to, showing a 6-roll breaker stack located between the dryer and a size press. The breaker press rolls require operational space, and there is a substantial open draw between the breaker press and the downstream size press. Such an arrangement involves costly construction and operation and provides operational hazards to the extent that the operator must be concerned with the mechanism during threading and tending of the machine.

A substantial improvement in supplying the need for a combined breaker and size press coater for simultaneously effecting breaking of the sheet and coating in which a breaker roller cooperates with one side of an intermediate roll for breaking and a coating roll cooperates with the opposite side of the intermediate roll for coating the continuously running strip is disclosed in my U.S. Pat. No. 4,192,712, issued Mar. 11, 1980, assigned to the same assignee as the present application. However, that arrangement does not meet the needs of a simple, efficient 3-roll combined size press and breaker stack in which breaking and coating or sizing are alternately accomplished where the mill must switch with some frequency from breaker to coating operation as where a run of groundwood sheets must be run from time to time alternately with woodfree sheets.

It is therefore an important object of the present invention to provide a new and improved combined breaker and size press or coater, and method, and which with a compact 3-roll arrangement will serve the purpose alternately as a coating press or as a breaker stack, eliminating the necessity for changing of rolls or providing a separate installation for both the coating press and the breaker stack.

Accordingly, the invention provides in a paper web processing apparatus, wherein a paper web travels continuously from a supply to a disposition point, supporting structure, a rotary breaker roll mounted in an operatively stationary location on the supporting structure, a rotary coating press roll mounted in an operatively stationary location on the supporting structure substantially spaced from the breaker roll, a rotary intermediate roll located between, and of a diameter less than the spacing between, the breaker roll and the press roll, means shiftably mounting the intermediate roll on the supporting structure within alternate nipping range relative to the breaker roll and the press roll, means for guiding the paper web to run selectively through the nip of the breaker and intermediate rolls, or through the nip of the press and intermediate rolls, means for actuating the mounting means for selectively alternately shifting the intermediate roll into nipping relation with either the breaker roll or the press roll, and means for applying coating material to the paper web while running through the nip of the intermediate and press rolls.

The foregoing apparatus combination is especially adapted for practicing a new and improved method of processing a paper web traveling continuously from a supply to a disposition point, and according to which the web may be selectively run through a coating nip or a breaker nip alternatively, in the 3-roll assembly of the combination size press and breaker stack.

Figure 2:
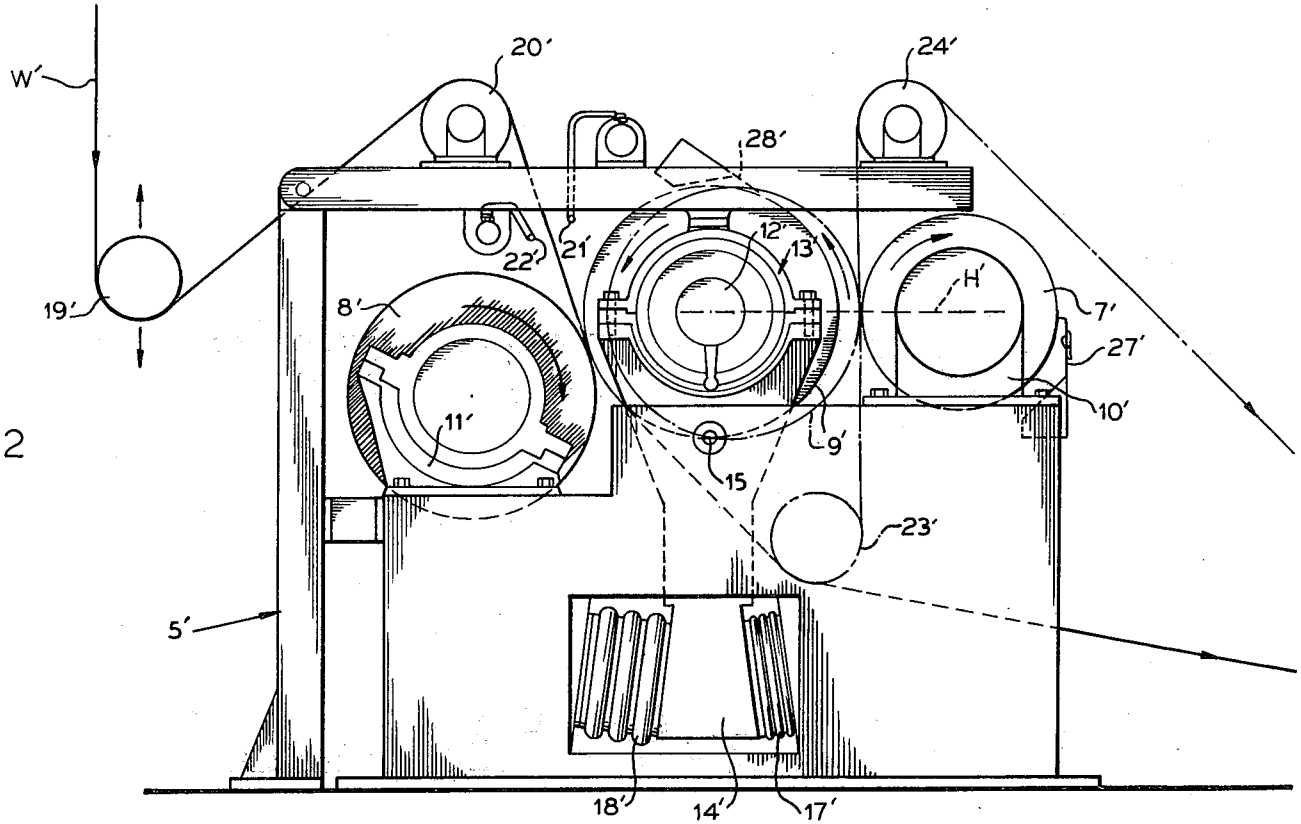

Other objects, features and advantages of the invention will be readily apparent from the following description of certain representative embodiments thereof, taken in conjunction with the accompanying drawings although variations and modifications may be effected without departing from the spirit and scope of the novel concepts embodied in the disclosure and in which:

FIG. 1 is a more or less schematic front elevational view of apparatus embodying the invention; and FIG. 2 is a more or less schematic front elevational view of a modified apparatus embodying the invention.

Referring to FIG. 1, a machine frame or supporting structure 5 supports in a compact arrangement a rotary breaker roll 7 mounted in an operatively stationary location on the supporting structure 5. A rotary size or coating press roll 8 is mounted in operatively stationary relation on the supporting structure substantially spaced from the breaker roll 7. A rotary intermediate roll 9 is located between the breaker roll 7 and the press roll 8 and is of a diameter less than the spacing between the breaker and press rolls. The breaker roll 7 is desirably a hard surface roll such as chilled iron, as is customary for this type of roll. The press roll 8 is desirably a rubber covered roll. The intermediate roll 9 is desirably a hard surface roll and may be of stainless steel and of the controlled crown type. At its opposite ends the roll 7 has the usual journal means rotatably mounted in bearing means 10 stationarily secured in a suitable manner such as by bolting to the supporting structure. At opposite ends of the roll 8 customary journals are mounted in bearing means 11 secured in any suitable manner stationarily on the supporting structure.

Means are provided for shiftably mounting the intermediate roll 9 on the supporting structure 5 within alternate nipping range relative to the breaker roll 7 and the press roll 8. To this end, respective journals 12 of the roll 9 are rotatably mounted in bearing means 13 carried by arms means 14 attached by pivot means 15 to the supporting structure 5 at a point sufficiently below the bearing means 13 to afford a range of shifting movements as apparent on comparison of the full line and broken line positions of the roll 9 to provide for selective alternate nipping of the roll 9 with the rolls 7 and 8. Below the pivot 15, the arm 14 extends downwardly and has its lower end portion associated with means for selectively operating the arm for effecting the alternate shifting of the intermediate roll into nipping relation with either the breaker roll 7 or the press roll 8. By preference, the selective operating means comprise pneumatic bellows 17 and 18 located at respectively opposite sides of the arm 14 and having one of their respective ends attached to the arm 14 and the other of their respective ends attached to the supporting structure 5. This type of pneumatic bellows actuator is well-known in the art, and the means for operating the bellows are also well-known, namely, source of compressed air adapted to be delivered to inflate one of the bellows while the remaining bellows is deflated, depending on which direction is desired to shift the roll 9. Herein inflation of the bellows 18 causes the arm 14 to shift the roll 9 into nipping relation with the roll 8. On the other hand, inflation of the bellows 17 will cause nipping contact between the roll 9 and the roll 7. In a preferred orientation, the arrangement is such that where the nip contact between the rolls 7 and 9 is along a horizontal line H through the roll axes as shown, nip contact between the rolls 8 and 9 is at an elevation of about 20° above the horizontal line in order to improve the sheet runout of the nip.

Means are provided for guiding a paper web W selectively between the nip of the breaker roll 7 and the intermediate roll 9 or between the nip of the press roll 8 and the intermediate roll 9. For this purpose the web W traveling continuously from a supply is trained about a rotary tension roller 19 located at one side of the apparatus such as at the left side as shown. From the tension roller 19, the web is directed over a lead-in guide roller 20 mounted on the supporting structure 5 at a suitable location above the roll stack for running of the paper web downwardly into the nip of the press roll 8 and the intermediate roll 9 where they are in nipping relation for coating or sizing the web, as shown in full line in FIG. 1. This nip is therefore adapted to act as a puddle coater with coating or size material being applied to both sides of the web W simultaneously. A coating material shower 21 directs a supply of the material to the nip area and between the web W and the perimeter of the intermediate roll 9. Similarly, a supply shower 22 supplies the coating or sizing material to the area of the nip between the web W and the size press roll 8. From the size press nip the coated paper web travels downwardly and passes about a rotary lead-out roller 23 and is transported to a disposition point, where the paper web may be further processed, rolled, wrapped, or otherwise handled.

Where the paper web W is to be subjected to a breaking operation in the nip of the breaker roll 7 and the intermediate roll 9, the intermediate roll 9 is shifted from nipping relation to the roll 9 into breaker nipping relation to the roll 7, as shown in dashed outline in FIG. 1. For this purpose, the web W is trained over a lead-in roll 24 mounted on the supporting structure or frame 5 in a suitable position above the breaker nip. The web W is directed downwardly from the lead-in roller 24 into the breaker nip and below the breaker nip is guided away from the rolls by passing under the rotary lead-out roller 23 and then to the desired disposition point. By preference the breaker roll 7 is steam-heated to improve the smoothness of the treated paper web.

Since, when the intermedate roll 9 is in the coating nip relation to the press roll 8, the intermediate roll must rotate clockwise as seen in FIG. 1, and in the breaker nip relation to the breaker roll 7, the intermediate roll 9 must rotate counterclockwise, drive means for the roll 9 such as a motor 25 must be of the reversible type. Any suitable means such as individual motors or other driving means for the rolls 7 and 8 may, of course, be unidirectional, that is adapted to drive the roll 7 clockwise as shown and the roll 8 counterclockwise as shown. Desirably, helper drives may be provided for the tension roller 19 and the lead-in rollers 20 and 24, as well as the lead-out roller 23.

If preferred, instead of having two lead-in rollers 20 and 24, a single such lead-in roller may serve the purpose by mounting it for horizontal adjustment between sizing lead-in location and breaker lead-in location. In other words, such a single lead-in roller may be mounted so that it can be readily shifted, as on adjustment ways or otherwise, for ready shifting into and then retention in either selected position.

To maintain the breaker roll 7 clean and to avoid wrap-ups, a suitable doctor 27 may be provided. Similarly, for maintaining the intermediate roll 9 clean during the breaker operation and to avoid wrap-ups on the intermediate roll a doctor 28 is desirably provided.

In FIG. 2 is shown a modification in which the arrangement is such that the intermediate roll is adapted for unidirectional rotation. The purpose and operation of the several components of the apparatus are substantially the same as the arrangement in FIG. 1, except for reorientation of the operating rolls and certain of the guide rollers, and therefore identical primed reference characters have been adopted to show the similarity. In FIG. 2, the web W' is trained over the tension roller 19' and then over the lead-in roller 20' from which the web travels downwardly into the coating nip between the roll 9 and the rubber covered press roll 8' which in this instance is located at the left side of the intermediate roll 9' instead of at the right side as in FIG. 1. The roll 8' is rotatably supported on bearings providing a fixed or stationary mount for the roll 8' on the supporting structure of frame 5'. The roll 9' is pivotally mounted on the frame 5' by means of the pivot 15' and the arm 14' is adapted to be actuated by the inflatable bellows actuators 17' and 18', the actuator 18' being activated to place the roll 9' in coating press nipping relation to the press roll 8', and the actuator 17' being activated when it is desired to shift the arm 14' to drive the intermediate roll 9' into breaker nipping relation to the rotary breaker roll 7' which is mounted by bearing means 10' at the right side of the intermediate roll 9'. The spacing between the roll 7' and 8' is greater than the diameter of the intermediate roll 9' so that when the intermediate roll is in nipping relation to one of the rolls 7' or 8', it is spaced from the other of the rolls 7' or 8'. While the paper web W is running through the coating nip of the intermediate roll 9' and the size press roll 8', coating material is supplied through a coating material shower 21' to one side of the coating nip area and through a coating supply shower 22' to the other side of the coating nip.

From the coating nip between the roll 8' and the intermediate roll 9', the coated web travels downwardly and about a lead-out roll 23' and passes to a disposition point.

When the apparatus is to be used as a breaker press, the intermediate roll 9' is shifted away from the press roll 8' into breaker nip relation to the breaker roll 7'. In this instance the web W' is trained over the lead-in roller 20' and then through the gap between the rolls 8' and 9' and about the guide roller 23' and then upwardly through the breaker nip of the roll 7' and the roll 9'.

From the breaker nip, the web travels upwardly and about the guide roller 24′ which in this instance serves as a lead-out roller, and from the roller 24′ the web travels to the desired disposition point. A doctor 27′ acts on the surface of the roll 7′, and a doctor 28′ acts on the surface of the roll 9′ for roll perimeter cleaning and wrap-up preventing purposes.

By reason of the reorientation of the rolls 7′ and 8′, the breaker nip in FIG. 2 is along a horizontal line H′ through the axes of the roll 7′ and 9′, and the coating nip of the rolls 8′ and 9′ is below the horizontal line H′ by desirably about 20°. It will be appreciated that an advantage of the arrangement of FIG. 2 is that a simplified drive for the intermediate roll 9′ is practical since this roll need rotate only in one direction, that is counterclockwise as viewed in FIG. 2.

From the foregoing, it will be appreciated that the present invention provides substantial economies not only in the equipment but also in time savings due to not being required to change rolls when switching from breaker to coating operations. Less building space and safer paper web runs are attained as compared with some other types of installations. Some existing installations may easily be rebuilt with the apparatus of the present invention, and in the space thus saved additional dryers or other desirable apparatus may be installed.

It will be understood that variations and modifications may be effected without departing from the spirit and scope of the novel concepts of this invention.

I claim as my invention:

1. In a paper web processing apparatus, wherein a paper web travels continuously from a supply to a disposition point, the combination comprising:

supporting structure;

a rotary breaker roll mounted in an operatively stationary location on said supporting structure;

a rotary coating press roll mounted in an operatively stationary location on said supporting structure substantially spaced from said breaker roll;

a rotary intermediate roll located between, and of a diameter less than the spacing between, said breaker roll and said press roll;

means shiftably mounting said intermediate roll on said supporting structure within alternate nipping range relative to said breaker roll and said press roll;

means for guiding the paper web to run selectively through the nip of said breaker and intermediate rolls or through the nip of the press and intermediate rolls;

means for actuating said mounting means for selectively alternately shifting said intermediate roll into nipping relation with either said breaker roll or said press roll;

and means for applying coating material to the paper web while running through the nip of said intermediate and coating press rolls.

2. Apparatus according to claim 1, wherein said shiftable mounting means for said intermediate roll comprises bearing means rotatably supporting said intermediate roll, arm means supporting said bearing means, means pivotally attaching said arm means to said supporting structure, and said means for actuating said mounting means by acting upon said arm means.

3. Apparatus according to claim 2, wherein said breaker roll and said intermediate roll have their axes located on a common horizontal line and the nip of said press roll and said intermediate roll is substantially on said line, said size press roll and said intermediate roll being relatively located so that their nip is offset about 20° from said horizontal line, and said arm projects downwardly from the arm pivot which is located below the axis of said intermediate roll.

4. Apparatus according to claim 3, wherein said nip of said press roll and said intermediate roll is offset above said horizontal line.

5. Apparatus according to claim 3, wherein said nip of said press roll and said intermediate roll is offset below said horizontal line.

6. Apparatus according to claim 1, wherein said guiding means comprise a guide roller mounted on said supporting structure above said rolls and the paper web travels downwardly from said guide roller through the selected roll nip.

7. Apparatus according to claim 6, including lead-out guide roller means mounted on said supporting structure and toward which the paper web travels from the selected nip and continues to said disposition point.

8. Apparatus according to claim 1, wherein said means for guiding the paper web comprises a combination lead-out and lead-in roller which operates when the paper web is selectively run through one of said nips to guide the paper web from said one nip to travel to said disposition point, and said roller operating when the other of said nips is selected to guide the paper web for running through said other nip, and means for receiving the paper web from said other nip and guiding the web toward said disposition point.

9. Apparatus according to claim 1, including doctors cooperating with said breaker roll and said intermediate roll for cleaning the perimeters of the breaker roll and the intermediate roll when they are in nipping relation and for preventing rolls-ups of the paper web.

10. Apparatus according to claim 1, wherein said intermediate roll and said press roll define in their nipped relation a coating material puddle at the nip through which the paper web runs, and said means for applying coating material comprising coating supplying shower devices located to supply the coating material to said puddle at each respective side of the running web.

11. A method of processing a paper web traveling continuously from a supply to a disposition point, through apparatus including a rotary breaker roll and a rotary coating press roll mounted in relatively stationary and spaced relation to one another and having between them an intermediate roll of a diameter less than the spacing between the breaker and press rolls and alternately shiftable into nipping relation selectively with either the breaker roll or the press roll, the method comprising:

selectively shifting said intermediate roll into nipping relation to the breaker roll and guiding the paper web to travel through the resulting nip for breaking action on the web;

alternately selectively shifting the intermediate roll into nipping relation to said press roll and guiding the paper web through the resulting coating nip;

and applying coating material to the paper web while traveling through the nip of the intermediate and press rolls.

12. A method according to claim 11, comprising selectively swinging a pivotally mounted arm carrying said intermediate roll, and thereby effecting said shifting of the intermediate roll selectively into the alternate nipping relations to the breaker roll and the press roll.

13. A method according to claim 11, comprising guiding the paper web to travel downwardly into the selected roll nip.

14. A method according to claim 13, including directing the paper web to travel away from the selected nip, and guiding the web about lead-out roller means to the disposition point.

15. A method according to claim 11, comprising where the paper web runs selectively through the coating nip receiving and guiding the web beyond the coating nip about a guide roller from which the web travels to the disposition point, and where the intermediate roll has been selectively shifted into breaker nipping relation to the breaker roll running the paper web through a gap between the intermediate roll and the press roll and about said guide roll and from the guide roll through the breaker nip.

16. A method according to claim 11, which comprises doctoring the perimeters of the breaker roll and the intermediate roll when they are in nipping relation and thereby maintaining the breaker roll and the intermediate roll clean and preventing roll-up of the paper web.

17. A method according to claim 11, comprising defining a coating material puddle at the coating nip of the intermediate roll and the press roll and through which the paper web runs for coating the same, and applying the coating material as a shower to said puddle at each respective side of the running web.

* * * * *